US012623817B1

(12) United States Patent
Huang et al.

(10) Patent No.: US 12,623,817 B1
(45) Date of Patent: May 12, 2026

(54) DUAL SPOUT CUP

(71) Applicant: Guangdong Musen Daily Products Co., Ltd., Yangjiang City (CN)

(72) Inventors: SiHua Huang, Yangjiang City (CN); Desheng Deng, Yangjiang City (CN); Yong Lin, Yangjiang City (CN); Yuan Yin, Yangjiang City (CN)

( * ) Notice: Subject to any disclaimer, the term of this patent is extended or adjusted under 35 U.S.C. 154(b) by 0 days.

(21) Appl. No.: 18/811,660

(22) Filed: Aug. 21, 2024

(30) Foreign Application Priority Data

Jul. 11, 2024 (CN) ..... 202410929515.3

(51) Int. Cl.
*B65D 47/06* (2006.01)
*A47G 19/22* (2006.01)
*B65D 25/28* (2006.01)

(52) U.S. Cl.
CPC ..... *B65D 47/06* (2013.01); *A47G 19/2272* (2013.01); *B65D 25/28* (2013.01); *B65D 2543/00046* (2013.01)

(58) Field of Classification Search
CPC ..... B65D 47/06; B65D 25/28; B65D 2543/00046; A47G 19/2272
See application file for complete search history.

(56) References Cited

U.S. PATENT DOCUMENTS 8,672,174 B1 * 3/2014 McMullin ..... B65D 47/305 222/533
2018/0332987 A1 * 11/2018 Lin ..... B65D 47/305
2021/0086960 A1 * 3/2021 Wang ..... B65D 25/46
2024/0109045 A1 * 4/2024 Tonn ..... B01F 33/50111
2024/0391656 A1 * 11/2024 Noveletsky ..... B65D 51/242
2025/0042631 A1 * 2/2025 Wu ..... B65D 51/242

FOREIGN PATENT DOCUMENTS

CN 117860089 A * 4/2024 ..... A47G 19/2272

OTHER PUBLICATIONS

Translation of CN117860089 provided by Espacenet. (Year: 2025).*

* cited by examiner

*Primary Examiner* — James N Smalley
(74) *Attorney, Agent, or Firm* — Shen Huang

(57) ABSTRACT

The disclosure discloses a dual spout cup comprising a cup body; a cup lid body, covering the cup body, a direct drinking channel and a sucking channel running through the cup lid body, a direct drinking spout being convexly provided around the direct drinking channel at an upper side of the cup lid body, the sucking channel being arranged at a rear side of the direct drinking spout; a flip-top structure, having a rear side rotatably connected to the cup lid body and having a closed state in which the direct drinking channel is covered and an open state in which the direct drinking channel is opened; and a handle structure, having a rear side rotatably connected to the cup lid body and/or the flip-top structure and having a folded state of being folded relative to the cup lid body and an unfolded state of being unfolded relative to the cup lid body.

19 Claims, 13 Drawing Sheets

DUAL SPOUT CUP

FIELD OF TECHNOLOGY

The disclosure relates to the field of cups, in particular to a dual spout cup.

BACKGROUND

A cup is a vessel specifically designed to hold liquids such as water, tea, coffee, etc. A double mouthed cup is equipped with both a drinking spout and a suction spout, providing two ways of drinking water and is highly favored by people.

The existing double mouthed cup, such as the utility model patent for a double drinking cup lid and cup named "Comfortable Drinking Water" authorized by China on Apr. 26, 2022 (publication number: CN216364641U), includes a main cover body, a first flip cover, and a second flip cover. The rear side of the first flip cover is rotatably connected to the rear side of the main cover body, the front side is connected to the main cover body through an opening button, the rear side of the second flip cover is rotatably connected to the rear side of the first flip cover, and the front side is connected to the main cover body through a buckle. The main cover body is provided with a straight drinking mouth and a straw mouth, and the straight drinking mouth is equipped with a straight drinking mouth. The first flip cover is equipped with a suction mouth. When direct drinking is required, open the first flip cover by pressing the lid opening button to drink directly through the drinking nozzle. When suction is required, close the first flip cover to connect the suction nozzle with the straw mouth, and open the second flip cover to suck through the suction nozzle. However, in this technical solution, the lid opening button is prone to accidental opening due to accidental contact, resulting in low safety and inconvenience for people.

SUMMARY

In view of the defects in the prior art, the disclosure provides a dual spout cup, which solves the technical problem that the lid opening button of the dual spout cup is easily opened by accidental pressing.

The disclosure provides a dual spout cup, comprising: a cup body, having an accommodating cavity inside and a straw extending into the accommodating cavity;a cup lid body, covering the cup body, a direct drinking channel and a sucking channel running through the cup lid body, a direct drinking spout being convexly provided around the direct drinking channel at an upper side of the cup lid body, the sucking channel being arranged at a rear side of the direct drinking spout, and an upper end of the straw being communicated with the sucking channel;a flip-top structure, having a rear side rotatably connected to the cup lid body and having a closed state in which the direct drinking channel is covered and an open state in which the direct drinking channel is opened, a front side of the flip-top structure and the cup lid body being locked with each other or separated from each other by means of a lid opening button, the flip-top structure being rotatably connected with a sippy spout member, a water passage being provided in the sippy spout member, the sippy spout member having a folded state of being folded relative to the flip-top structure and an unfolded state of being unfolded relative to the flip-top structure, when the flip-top structure is in the closed state and the sippy spout member is in a closed state, the sippy spout member blocking the sucking channel, and when the flip-top structure is in the closed state and the sippy spout member is in an open state, the water passage of the sippy spout member being communicated with the sucking channel; and a handle structure, having a rear side rotatably connected to the cup lid body and/or the flip-top structure and having a folded state of being folded relative to the cup lid body and an unfolded state of being unfolded relative to the cup lid body, a front side of the handle structure shielding an outer side of the lid opening button when in the folded state, and being arranged at an angle with the lid opening button and exposing the lid opening button when in the unfolded state.

According to the dual spout cup provided by the disclosure, when the handle structure is rotated to the folded state of being folded relative to the cup lid body, the handle structure can shield the outer side of the lid opening button, which avoids accidentally opening the flip-top structure by accidentally pressing the lid opening button, thereby reducing the space occupied by the handle structure in the dual spout cup, making the dual spout cup convenient to package or carry, improving the safety in use, avoiding accidentally opening the lid opening button, and having high practicability. When the handle structure is rotated to the unfolded state of being unfolded relative to the cup lid body, the lid opening button can be exposed, so that an operator can press the lid opening button, which is simple and convenient to operate. The handle structure functions as both a handle and a safety lock. The structure is simple and ingenious in design and convenient to produce and assemble. The direct drinking channel and the sucking channel run through the cup lid body, the direct drinking spout is convexly provided around the direct drinking channel at the upper side of the cup lid body, the upper end of the straw is communicated with the sucking channel, the flip-top structure is rotatably connected with the sippy spout member, and the water passage is provided in the sippy spout member. Therefore, before use, the operator may choose to press the lid opening button and rotate the flip-top structure relative to the cup lid body to make the direct drinking spout in the open state, and then drink water sequentially via the direct drinking channel and the direct drinking spout. Alternatively, the operator may choose, when the flip-top structure covers the cup lid body, to rotate the sippy spout member relative to the flip-top structure to make the water passage communicated with the sucking channel such that the sippy spout member is in the unfolded state, and then suck water sequentially via the straw, the sucking channel and the sippy spout member, so that the operator can drink water in more than one way, which is convenient and practical. In this example, the handle structure has the rear side rotatably connected to both the cup lid body and the flip-top structure, which is steady and firm in connection. In other examples, the handle structure may have the rear side rotatably connected to either the cup lid body or the flip-top structure.

BRIEF DESCRIPTION OF THE DRAWINGS

The accompanying drawings described herein are intended to provide further understanding of the present invention and form a part of the present application. The illustrative embodiments of the present invention and their description are used to explain the present invention and do not constitute undue limitation of the present invention. In the attached figure.

DESCRIPTION OF THE EMBODIMENTS

Figure 1:
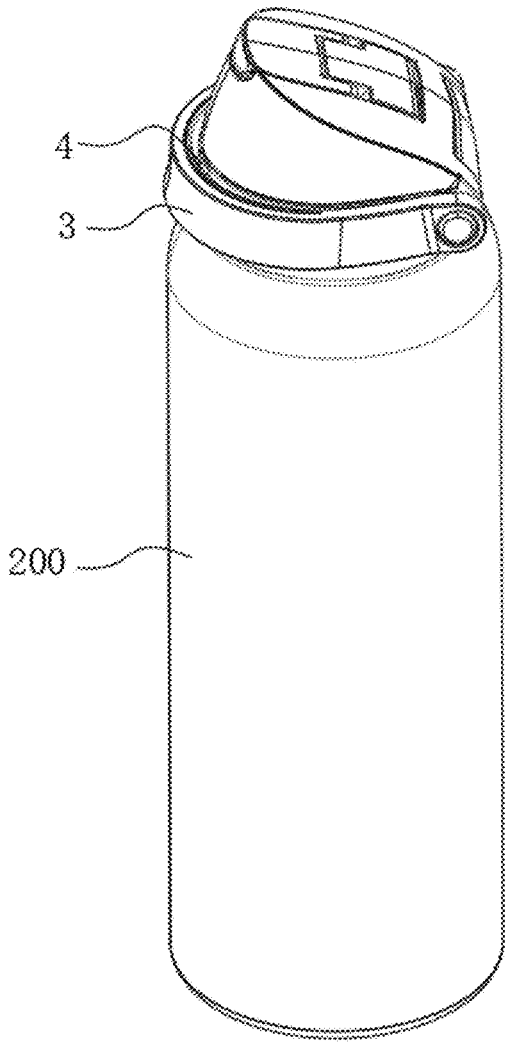
FIG. 1 to FIG. 4 are schematic structural views of a dual spout cup according to an example of the disclosure.
Figure 2:
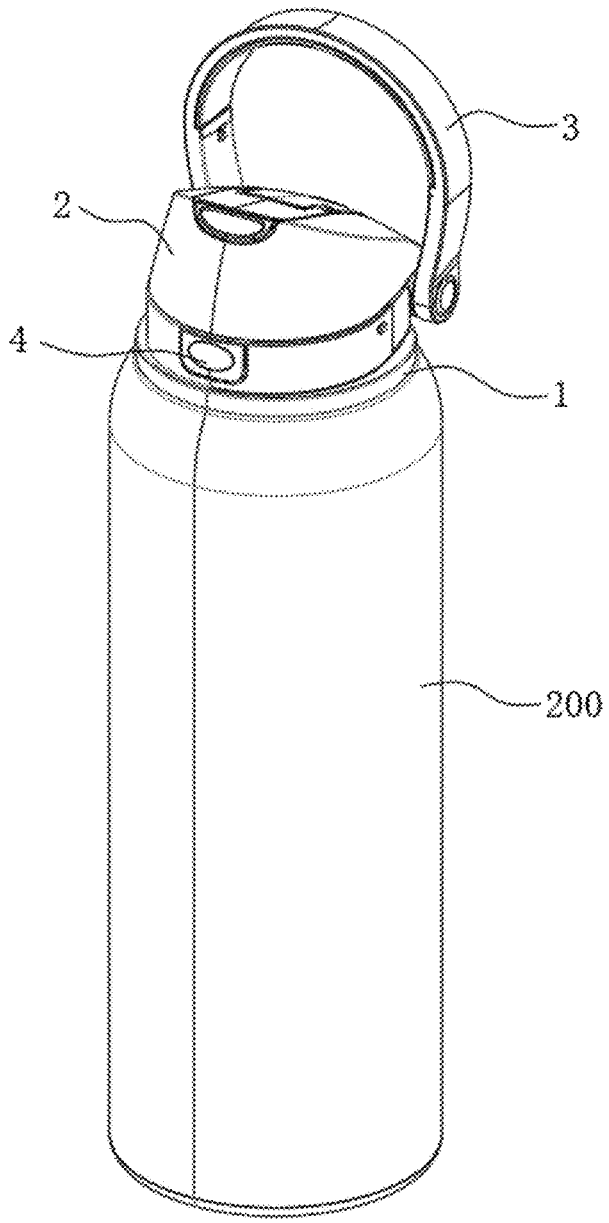
Figure 3:
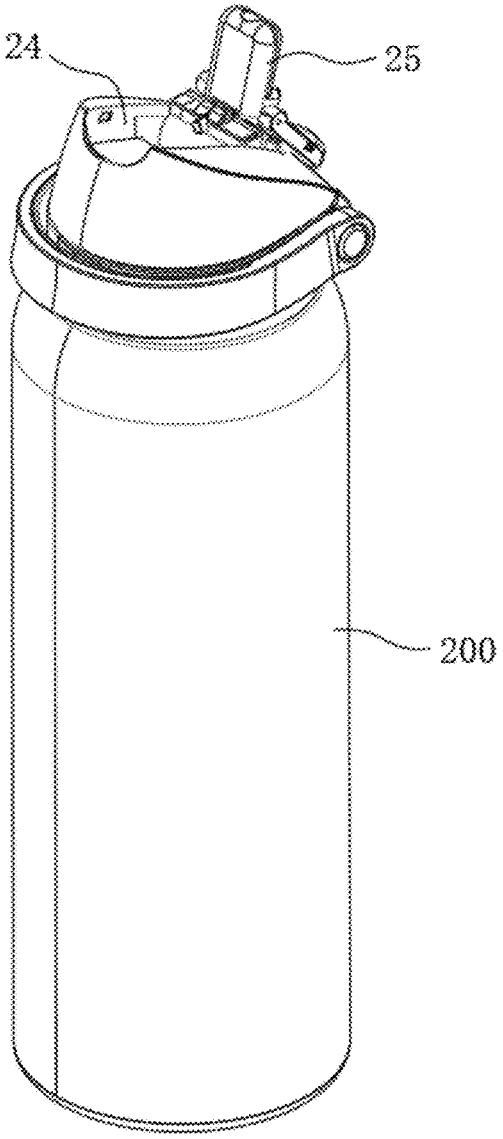
Figure 4:
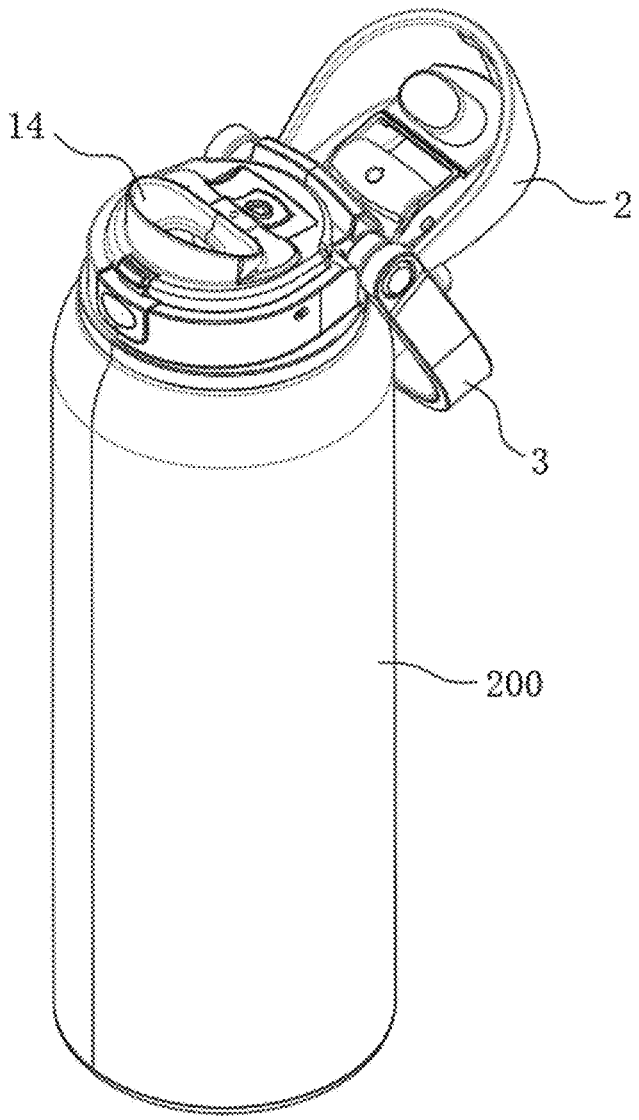
Figure 5:
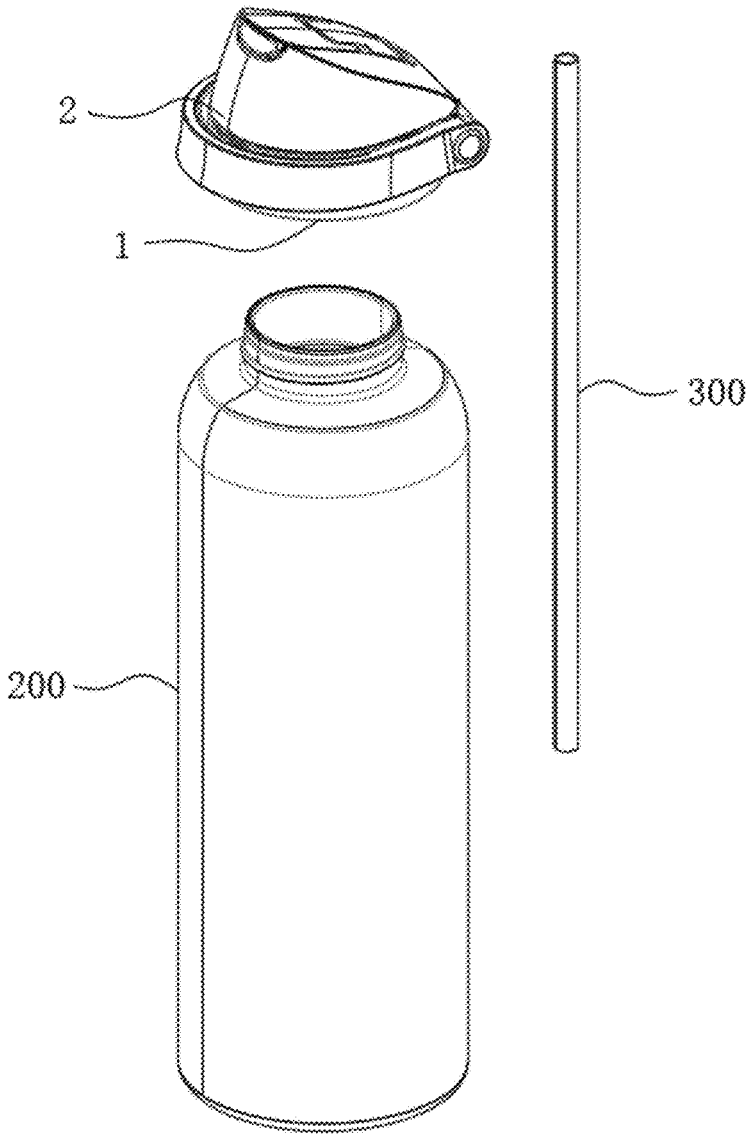
FIG. 5 is a schematic structural exploded view of the dual spout cup according to an example of the disclosure.
Figure 6:
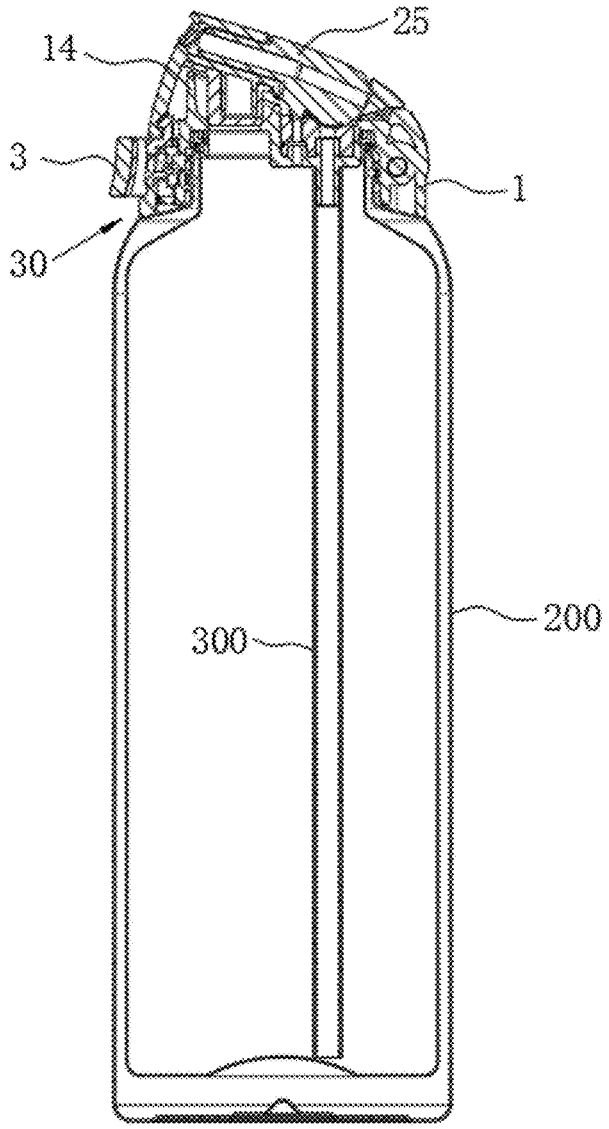
FIG. 6 to FIG. 8 are schematic structural sectional view of the dual spout cup according to an example of the disclosure.
Figure 7:
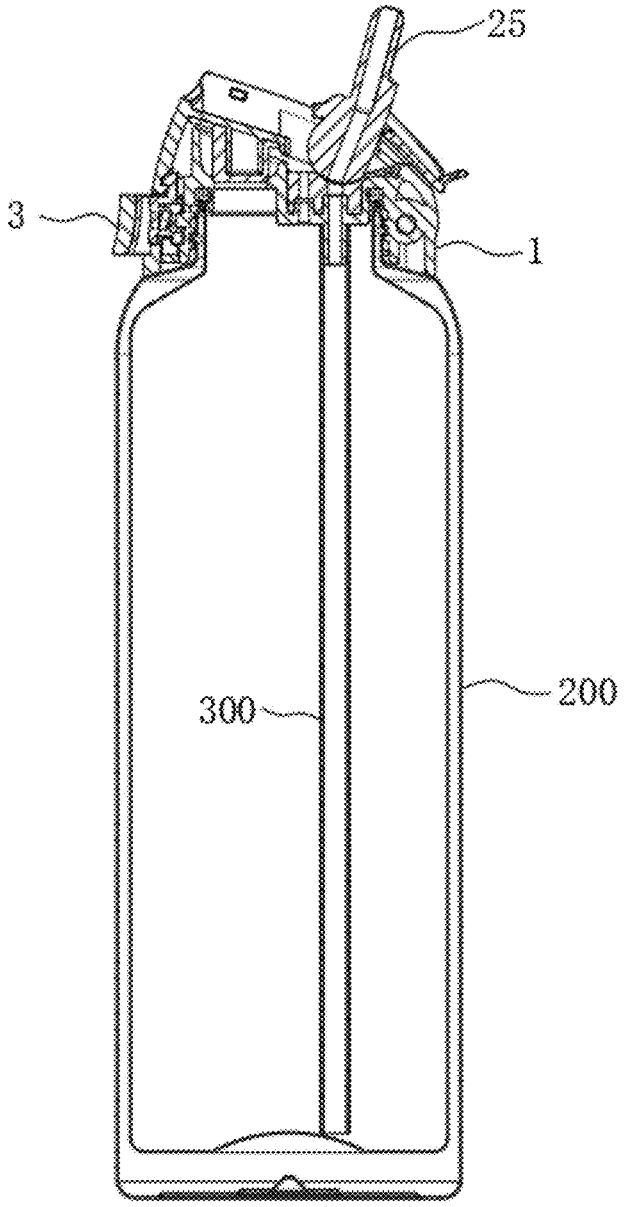
Figure 8:
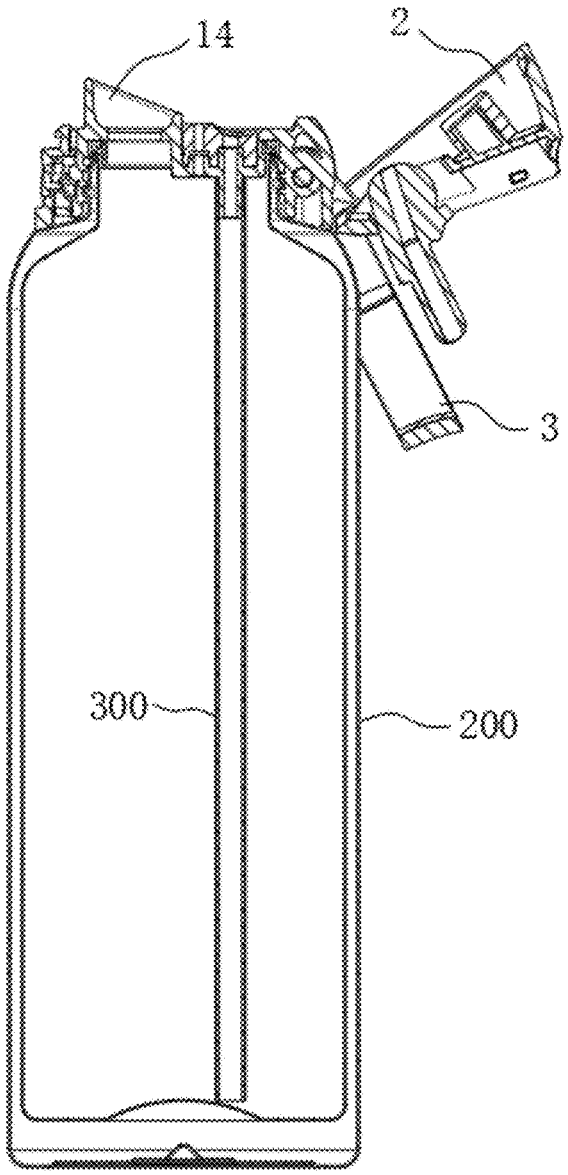

In order to clarify the purpose, technical solution, and advantages of the embodiments of the present invention, the following will provide a clear and complete description of the technical solution of the embodiments of the present invention in conjunction with the accompanying drawings.

As shown in FIG. 1 to FIG. 18, an example of the disclosure provides a dual spout cup, including a cup body 200, a cup lid body 1, a flip-top structure 2 and a handle structure 3. The cup body 200 has provided with an accommodating cavity inside and a straw 300 extending into the accommodating cavity. The cup lid body 1 covers the cup body 200. A direct drinking channel 111 and a sucking channel 112 run through the cup lid body 1. A direct drinking spout 14 is convexly provided around the direct drinking channel 111 at an upper side of the cup lid body 1. The sucking channel 112 is arranged at a rear side of the direct drinking spout 14, and an upper end of the straw 300 is communicated with the sucking channel 112. The flip-top structure 2 has a rear side rotatably connected to the cup lid body 1 and has a closed state in which the direct drinking channel is covered 111 and an open state in which the direct drinking channel 111 is opened. A front side of the flip-top structure 2 and the cup lid body 1 are locked with each other or separated from each other by means of a lid opening button 4. The flip-top structure 2 is rotatably connected with a sippy spout member 25. A water passage 250 is provided in the sippy spout member 25. The sippy spout member 25 has a folded state of being folded relative to the flip-top structure 2 and an unfolded state of being unfolded relative to the flip-top structure 2. When the flip-top structure 2 is in the closed state and the sippy spout member 25 is in a closed state, the sippy spout member 25 blocks the sucking channel 112, and when the flip-top structure 2 is in the closed state and the sippy spout member 25 is in an open state, the water passage 250 of the sippy spout member 25 is communicated with the sucking channel 112. The handle structure 3 has a rear side rotatably connected to the cup lid body 1 and the flip-top structure 2 and has a folded state of being folded relative to the cup lid body 1 and an unfolded state of being unfolded relative to the cup lid body 1. A front side of the handle structure shields an outer side of the lid opening button 4 when in the folded state, and is arranged at an angle with the lid opening button 4 and exposes the lid opening button 4 when in the unfolded state. In this example, when the handle structure 3 is rotated to the folded state of being folded relative to the cup lid body 1, the handle structure 3 can shield the outer side of the lid opening button 4, which avoids accidentally opening the flip-top structure 2 by accidentally pressing the lid opening button 4, thereby reducing the space occupied by the handle structure 3 in the dual spout cup, making the dual spout cup convenient to package or carry, improving the safety in use, avoiding accidentally opening the lid opening button 4, and having high practicability. When the handle structure 3 is rotated to the unfolded state of being unfolded relative to the cup lid body 1, the lid opening button 4 can be exposed, so that an operator can press the lid opening button 4, which is simple and convenient to operate. The handle structure 3 functions as both a handle and a safety lock. The structure is simple and ingenious in design and convenient to produce and assemble. The direct drinking channel 111 and the sucking channel 112 run through the cup lid body 1, the direct drinking spout 14 is convexly provided around the direct drinking channel 111 at the upper side of the cup lid body 1, the upper end of the straw 300 is communicated with the sucking channel 112, the flip-top structure 2 is rotatably connected with the sippy spout member 25, and the water passage 250 is provided in the sippy spout member 25. Therefore, before use, the operator may choose to press the lid opening button 4 and rotate the flip-top structure 2 relative to the cup lid body 1 to make the direct drinking spout 14 in the open state, and then drink water sequentially via the direct drinking channel 111 and the direct drinking spout 14. Alternatively, the operator may choose, when the flip-top structure 2 covers the cup lid body 1, to rotate the sippy spout member 25 relative to the flip-top structure 2 to make the water passage 250 communicated with the sucking channel 112 such that the sippy spout member 25 is in the unfolded state, and then suck water sequentially via the straw 300, the sucking channel 112 and the sippy spout member 25, so that the operator can drink water in more than one way, which is convenient and practical. In this example, the handle structure 3 has the rear side rotatably connected to both the cup lid body 1 and the flip-top structure 2, which is steady and firm in connection. In other examples, the handle structure 3 may have the rear side rotatably connected to either the cup lid body 1 or the flip-top structure 2.

Figure 9:
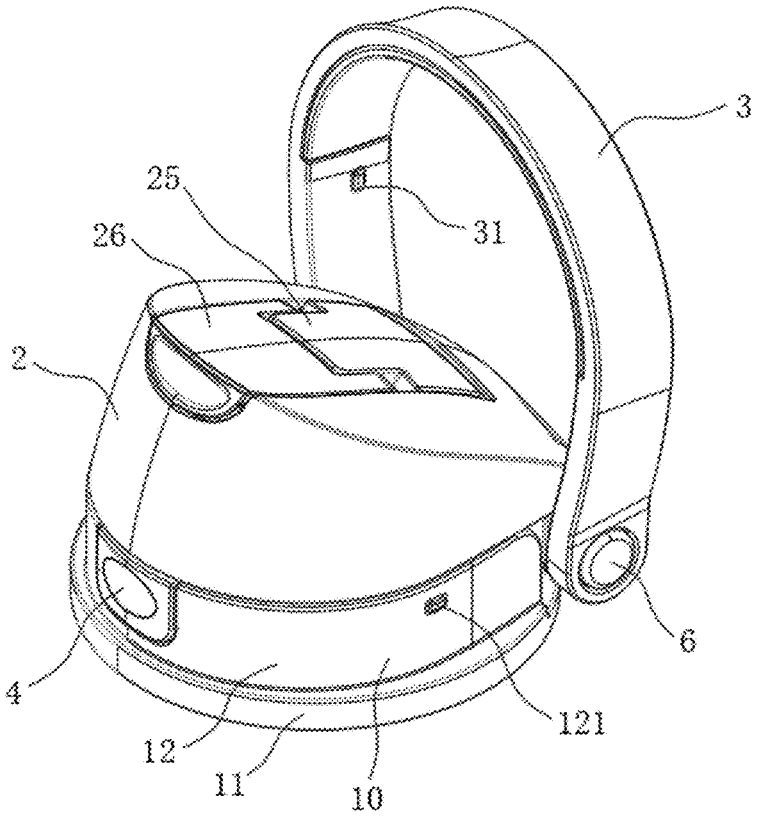
FIG. 9 to FIG. 11 are schematic partial structural views of the dual spout cup in use according to an example of the disclosure.

As shown in FIG. 9, in some specific examples, an inner diameter of the handle structure 3 is greater than an outer diameter of the flip-top structure 2. The flip-top structure 2 rotates relative to the cup lid body 1 in a first rotating space, and the handle structure 3 rotates relative to the cup lid body 1 in a second rotating space. The first rotating space is arranged at an inner side of the second rotating space. An accommodating area 10 for accommodating the handle structure 3 is formed at an outer side of the cup lid body 1. In this example, the lid opening button 4 is mounted on the cup lid body 1, and the accommodating area 10 is arranged at the outer side of the cup lid body 1 corresponding to the lid opening button 4. As another example of the disclosure, the lid opening button 4 is mounted on the flip-top structure 2, and the accommodating area 10 is arranged at the outer side of the flip-top structure 2 corresponding to the lid opening button 4.

Figure 12:
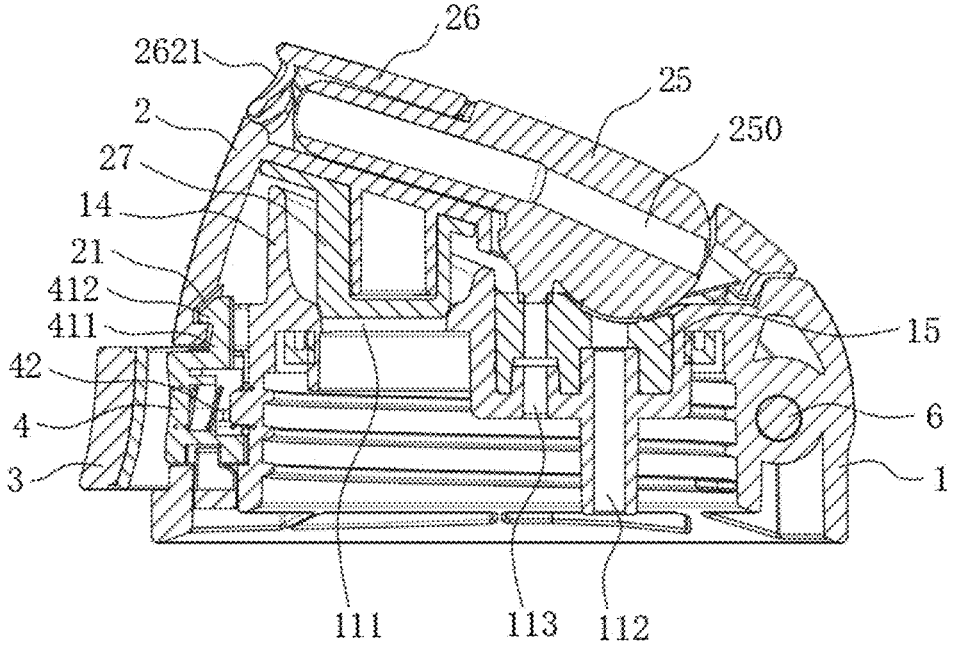
FIG. 12 to FIG. 14 are schematic partial structural sectional views of the dual spout cup according to an example of the disclosure.

As shown in FIG. 12, in some specific examples, the cup lid body 1 includes a cup lid base 11 and a mounting base 12 convexly provided at an upper side of the cup lid base 11. An outer diameter of the mounting base 12 is less than an outer diameter of the cup lid base 11 so as to form the accommodating area 10 between an outer side surface of the mounting base 12 and an upper side surface of the cup lid base 11. When the handle structure 3 is in the folded state, the handle structure 3 abuts against the upper side surface of the cup lid base 11 so as to be limited at the upper side of the cup lid base 11, which prevents the handle structure 3 from rotating downward excessively. The flip-top structure 2 covers an upper side of the mounting base 12. That is, the flip-top structure 2 is arranged at the upper side of the accommodating area 10, and there is a certain distance between the accommodating area 10 and the flip-top structure 2, which can prevent the handle structure 3 in the folded state from being accidentally touched and flipped to above the flip-top structure 2 to some extent, causing the failure in shielding the lid opening button 4.

As shown in FIG. 9, in some specific examples, an outer side wall of the mounting base 12 is provided with a first fastening portion 121, and an inner side wall of the handle structure 3 is provided with a second fastening portion 31 arranged corresponding to the first fastening portion 121; and when the handle structure 3 is in the folded state, the first fastening portion 121 and the second fastening portion 31 are fastened with each other so as to be locked, so that the handle structure 3 can be locked in the accommodating area 10, which makes the dual spout cup convenient to package or carry.

In some specific examples, the first fastening portion 121 is formed by protruding from the outer side surface of the mounting base 12, and the second fastening portion 31 is formed by protruding from an inner side surface of the handle structure 3; and when the handle structure 3 is in the folded state, the second fastening portion 31 abuts against a lower side surface of the first fastening portion 121 so as to be limited at a lower side of the first fastening portion 121, so that the handle structure 3 can be locked in the accommodating area 10 by limiting the handle structure 3 between the upper side of the cup lid base 11 and the lower side of the first fastening portion 121. In other examples, the first fastening portion 121 or the second fastening portion 31 may also be provided as a recess structure, and the handle structure 3 can also be locked in the accommodating area 10 by means of the fit between the concave and convex structures of the first fastening portion 121 and the second fastening portion 31.

As shown in FIG. 12, in some specific examples, when the handle structure 3 is in the folded state, the front side of the handle structure 3 protrudes from an outer side of the cup lid base 11 so as to form a pulling space 30 between a lower side of the handle structure 3, an outer side of the cup lid base 11 and an outer side of the cup body 200 for a finger of an operator to extend into. In this way, the operator can extend the finger into the pulling space 30 and pull up the handle structure 3 to make the first fastening portion 121 separated from the second fastening portion 31, and further pull the handle structure 3 to rotate to the unfolded state relative to the cup lid body 1 to expose the lid opening button 4, so that the operator can press the lid opening button 4 to open the flip-top structure 2.

As shown in FIG. 11 to FIG. 14, in some specific examples, a front side of the mounting base 12 is concavely provided with a button slot 122. The lid opening button 4 is movably connected in the button slot 122, and an outer side surface of the lid opening button 4 is flush or basically flush with the outer side surface of the mounting base 12, which prevents the lid opening button 4 from interfering with the rotation of the handle structure 3 and makes the overall structure of the dual spout cup more compact, thereby further reducing the occupied space of the dual spout cup and making the dual spout cup convenient to package and transport. An upper side of the lid opening button 4 is provided with a first locking portion 41, and the flip-top structure 2 is provided with a second locking portion 21 arranged corresponding to the first locking portion 41. A front side of the flip-top structure 2 and a front side of the cup lid body 1 are locked by fastening the first locking portion 41 with the second locking portion 21, and separated by separating the first locking portion 41 from the second locking portion 21. A first return member 42 is arranged between the lid opening button 4 and the button slot 122. The first return member 42 is configured to drive the lid opening button 4 to automatically return to its original position so as to keep the lid opening button 4 in a locked position after an operator presses the lid opening button 4. The first return member 42 may be a structure with elastic force such as a compression spring or elastic silicone.

In some specific examples, the first locking portion 41 includes a first connecting block 411 formed by protruding from the upper side of the lid opening button 4 along a vertical direction, and a first locking block 412 formed by protruding from an outer side of the first connecting block 411 along a horizontal direction. The second locking portion 21 is provided as a recess structure formed by recessing from an inner side surface of a side wall of the flip-top structure 2, and one side of the flip-top structure 2 and the cup lid body 1 are locked by making the first locking block 412 extend into and be fastened with the second locking portion 21. Two sides of the lid opening button 4 are respectively convexly provided with a guide block 43, and two side walls of the button slot 122 are respectively provided with a guide groove 1221 along a pressing direction of the lid opening button 4; and when the lid opening button 4 is pressed, the guide blocks 43 extend into the correspondingly arranged guide grooves 1221 and slide along the guide grooves 1221 so as to guide the lid opening button, which improves the stability of the pressing operation.

Figure 16:
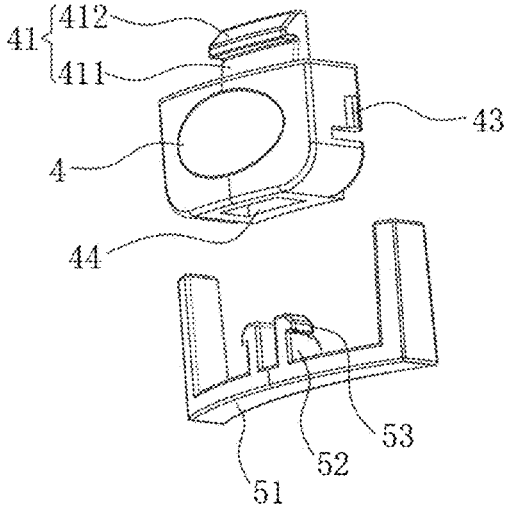
FIG. 16 is a schematic structural view of a lid opening button and a limiting structure according to an example of the disclosure.

As shown in FIG. 16, in some specific examples, a bottom of the button slot 122 is assembled with a limiting structure 5. The limiting structure 5 includes a limiting body 51, a second connecting block 52 formed by protruding from an upper side of the limiting body 51 along a vertical direction, and a limiting block 53 formed by protruding from an outer side of the second connecting block 51 along a horizontal direction. A bottom wall of the button slot 122 is provided with an assembly channel 1222 for the second connecting block 52 to pass through. The limiting structure 5 and the button slot 122 are assembled by fastening the bottom wall of the button slot 122 between a lower side of the limiting block 53 and the upper side of the limiting body 51. A bottom of the lid opening button 4 is concavely provided with a limiting groove 44 arranged along the pressing direction of the lid opening button 4. The limiting block 53 is arranged in the limiting groove 44, which prevents the lid opening button 4 from being disconnected from the cup lid body 1. When the lid opening button 4 slides along the pressing direction, the limiting block 53 moves in the limiting groove 44.

Figure 15:
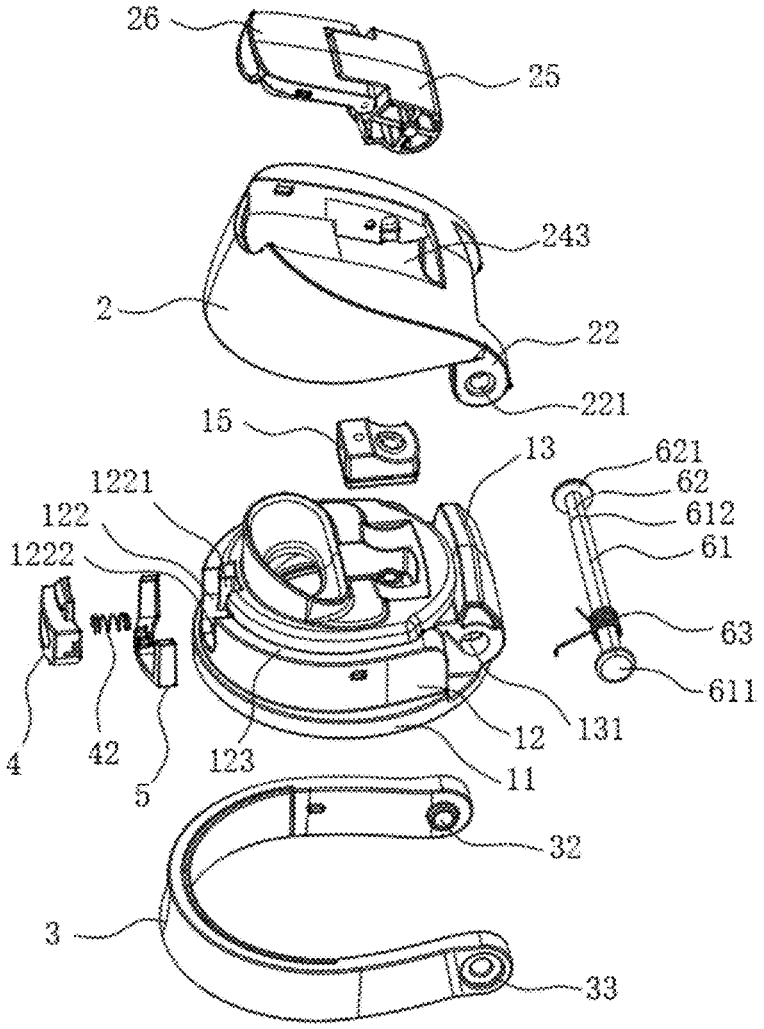
FIG. 15 is a schematic partial structural exploded view I of the dual spout cup according to an example of the disclosure.

As shown in FIG. 15, in some specific examples, the cup lid body 1 further includes a rotating base 13 convexly provided at an upper side of the cup lid base 11. The rotating base 13 is arranged at a rear side of the mounting base 12. The rotating base 13 is provided with a rotating shaft 6. The rotating shaft 6 and the accommodating area 10 are located on a same horizontal plane. The flip-top structure 2 includes connecting members 22 respectively arranged at two sides of the rotating base 13. The handle structure 3 is provided as an arc-shaped structure arranged around an outer side of the mounting base 12. The two connecting members 22 are respectively provided with a first rotating channel 221 arranged corresponding to the rotating shaft 6. Two ends of the arc-shaped structure are respectively arranged at outer sides of the two connecting members 22 and respectively provided with a second rotating channel 32 arranged corresponding to the rotating shaft 6. A third rotating channel 131 runs through the 13. The third rotating channel 131, each of the first rotating channels 221 and each of the second rotating channels 32 are arranged in a same straight line. The rotating shaft 6 sequentially runs through the third rotating channel 131, each of the first rotating channels 221 and each of the second rotating channels 32, so that the flip-top structure 2 and the handle structure 3 are rotatably connected to the cup lid body 1 respectively. The flip-top structure 2 and the cup lid body 1 are rotatably connected by means of the rotating shaft 6 running through the first rotating channels 221; and the handle structure 3 and the cup lid body 1 are rotatably connected by means of the rotating shaft 6 running through the second rotating channels 32. The flip-top structure 2 and the handle structure 3 can be rotatably connected to the cup lid body 1 only by one rotating shaft 6, which simplifies the structure and facilitates the assembly. The rotating shaft 6, the first rotating channels 221 and the second rotating channels 32 are arranged along the horizontal direction of the cup lid body 1, so that the flip-top structure 2 and the handle structure 3 can be flipped vertically relative to the cup lid body 1 around the rotating shaft 6.

As shown in FIG. 15, in some specific examples, the rotating shaft 6 includes a rotating shaft rod 61 and a limiting rod 62. One end of the rotating shaft rod 61 is convexly provided with a first end head 611 along its radial direction, and the other end is concavely provided with a connecting channel 612 from its end surface. One end of the limiting rod 62 is convexly provided with a second end head 621 along its radial direction, and the other end is inserted into the connecting channel 612, and is fitted and connected with the rotating shaft rod 61 by threaded connection, fastening connection, rivet connection or the like. Outer diameters of the first end head 611 and the second end head 621 are greater than an outer diameter of the second rotating channel 32, so that two ends of the handle structure 3 are respectively limited at inner sides of the first end head 611 and the second end head 621. Two ends of the handle structure 3 are respectively recessed from its outer side surface to form sinking grooves 33 for accommodating the first end head 611 and the second end head 621, so that the first end head 611 and the second end head 621 are flush or basically flush with the outer surface of the handle structure 3 respectively, which is compact in structure, further reduces the occupied space of the cup lid opening structure 100 and makes the dual spout cup convenient to package or carry. Moreover, the first end head 611 and the second end head 621 are accommodated in the sinking grooves 33, which can avoid pinching hands.

In some specific examples, the rotating shaft 6 is sleeved with a second return member 63 arranged between the cup lid body 1 and the flip-top structure 2. The second return member 63 is provided as a torsion spring configured to keep the flip-top structure 2 in the open state, so that when the operator presses the lid opening button 4, the second return member 63 can drive the flip-top structure 2 to automatically flip to the open state, which is convenient for direct drinking.

As shown in FIG. 15, in some specific examples, the mounting base 12 is concavely provided with a sinking platform 123 along its upper side edge; and when the flip-top structure 2 is in the closed state, a bottom of the flip-top structure 2 is arranged in the sinking platform 123 so as to be limited, which improves the stability of the flip-top structure 2 in the closed state. An outer surface of the flip-top structure 2 is flush or basically flush with a side surface of the mounting base 12, which prevents the flip-top structure 2 from interfering with the rotation of the handle structure 3. Thereby, on the premise of ensuring that the handle structure 3 can rotate at the outer side of the flip-top structure 2, the width of the flip-top structure 2 can be maximized, thereby providing a sufficient space for the arrangement of the direct drinking spout 14 and the sippy spout member 25.

Figure 17:
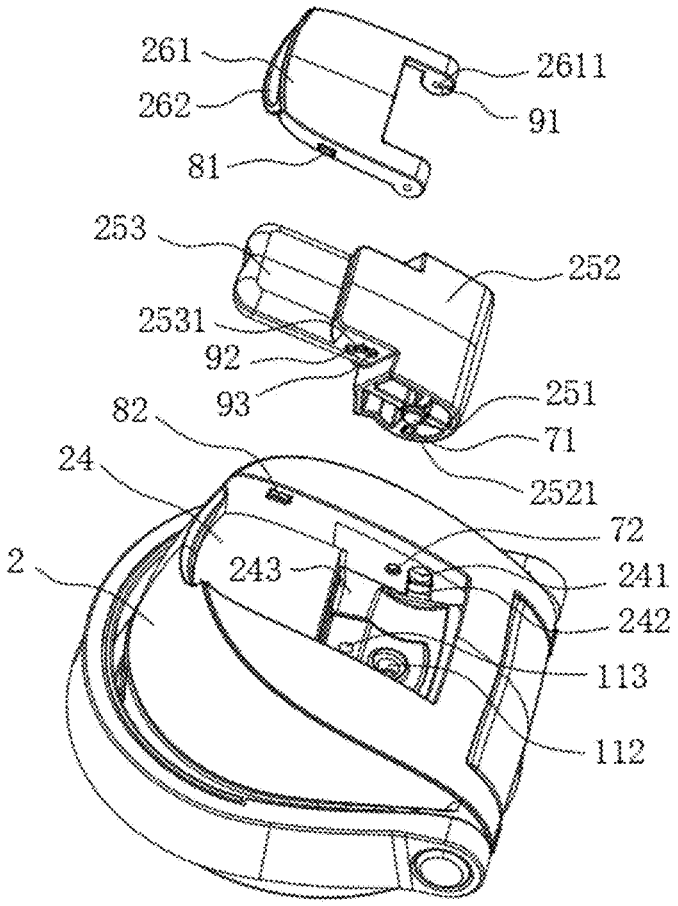
FIG. 17 is a schematic partial structural exploded view II of the dual spout cup according to an example of the disclosure.

As shown in FIG. 17, in some specific examples, a top of the flip-top structure 2 is concavely provided with an accommodating groove 24 for accommodating the sippy spout member. The sippy spout member 25 includes a rotating portion 252 and a sippy spout portion 253 connected with the rotating portion 252. The rotating portion 252 is rotatably connected in the accommodating groove 24. An outer side of the sippy spout portion 253 is rotatably connected with a sippy spout lid 26. The sippy spout lid 26 includes a first lid plate 261 shielding an outer side of the sippy spout portion 253 and a second lid plate 262 shielding an outer side of the water passage 250. The sippy spout lid 26 is configured to dust-proof and protect the sippy spout member 25. When the sippy spout member 25 can be accommodated in the accommodating groove 24 when in the folded state, which reduces the occupation of the outside space by the flip-top structure 2. Thereby, the dual spout cup is compact in overall structure, occupies a smaller space and is convenient to package or carry. In this example, when the sippy spout member 25 is accommodated in the accommodating groove 24, outer surfaces of the rotating portion 252 and the sippy spout lid 26 are flush or basically flush with an outer surface of the flip-top structure 2, thereby minimizing the occupied space of the dual spout cup. In other examples, the sippy spout member 25 in the folded state may also protrude from the surface of the flip-top structure 2.

In some specific examples, the sippy spout member 25 is locked in the folded state by means of second positioning structures arranged between the first lid plate 261 and the accommodating groove 24, which prevents the sippy spout member 25 in the folded state from rotating. Moreover, the sippy spout lid 26 protects the sippy spout member 25 inside from dust and pollution, which keeps the sippy spout member 25 clean. Each second positioning structure includes a second positioning portion 81 and a second limiting portion 82 arranged corresponding to the second positioning portion 81. The second positioning portions 81 are formed by respectively protruding from two sides of the first lid plate 261 in its width direction, and the second limiting portions 82 are formed by respectively recessing from two side walls of the accommodating groove 24 in its width direction. When the second positioning portions 81 snap into the second limiting portions 82, the sippy spout lid 26 is locked relative to the flip-top structure 2, so that the sippy spout member 25 can be locked in the folded state by making the second positioning portions 81 snap into the second limiting portions 82. The inner side of the second lid plate 262 shields the outer side of the water passage 250, which prevents dust and impurities from entering. An outer side of the second lid plate 262 is recessed to form a pulling groove 2621 for an operator to pull the sippy spout lid 26 open. The operator can pull the sippy spout lid 26 to rotate relative to the sippy spout portion 253 by means of the pulling groove 2621, so as to further drive the sippy spout member 25 to rotate to the unfolded state relative to the flip-top structure 2.

Figure 13:
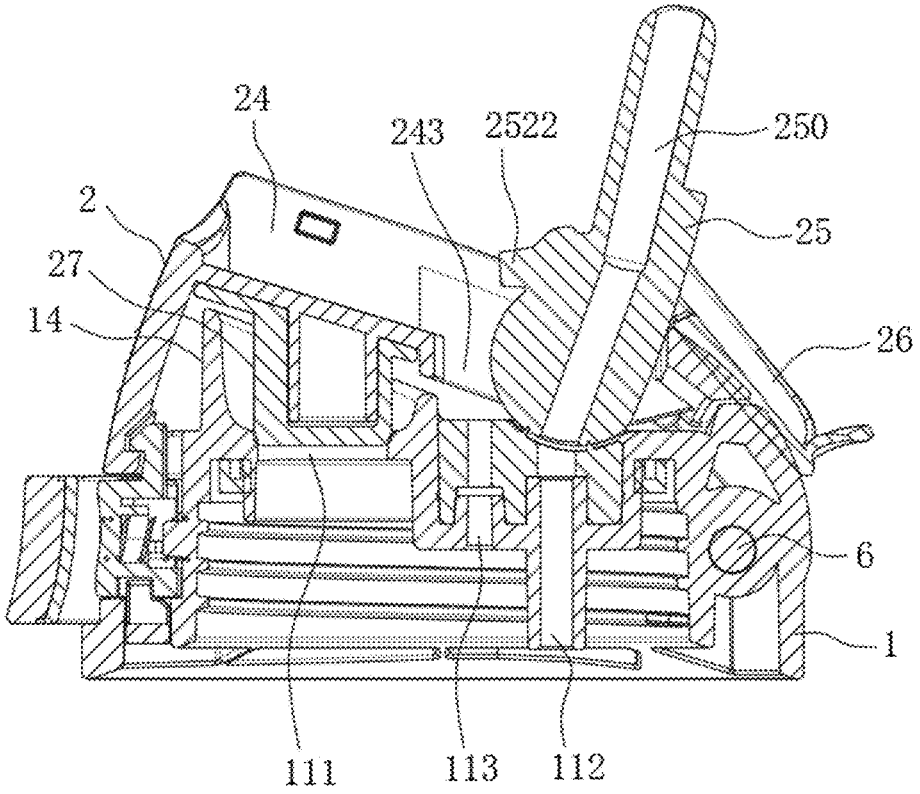
Figure 14:
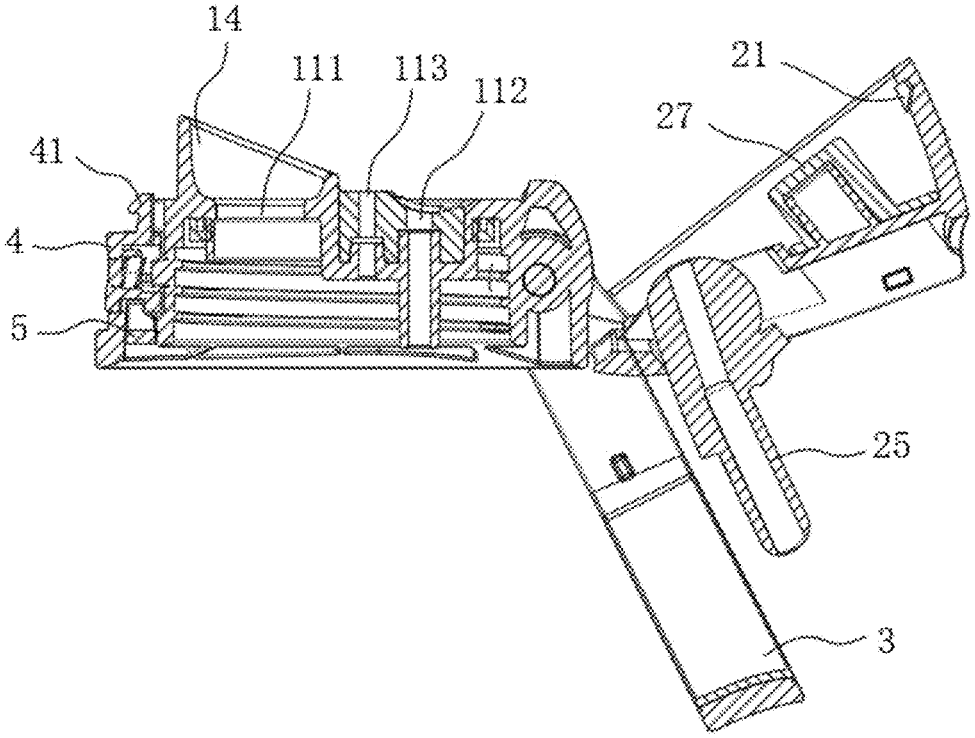

In some specific examples, the sippy spout member 25 is locked in the unfolded state by means of first positioning structures arranged between the rotating portion 252 and the accommodating groove 24. Each first positioning structure includes a first positioning portion 71 and a first limiting portion 72 arranged corresponding to the first positioning portion 71. One of each of the first positioning portion 71 and each of the first limiting portion 72 is arranged on the rotating portion 252, and the other is arranged on the accommodating groove 24. The sippy spout member 25 is locked in the unfolded state by making the first positioning portions 71 snap into the first limiting portions 72, so that the water passage 250 keeps communicating with the sucking channel 112, which prevents the sippy spout member 25 in the unfolded state from rotating, causing misalignment between the water passage 250 and the sucking channel 112 and affecting sucking. In this example, the first positioning portions 71 are formed by respectively protruding from two side walls of the rotating portion 252 in its width direction, and the first limiting portions 72 are formed by respectively recessing from two side walls of the accommodating groove 24 in its width direction. Two side walls of the rotating portion 252 in its width direction are further convexly provided with first connecting shafts 251, and two side walls of the accommodating groove 24 in its width direction are further recessed to form first shaft holes 241. The sippy spout member 25 and the flip-top structure 2 are rotatably connected by making the first connecting shafts 251 sleeved in the first shaft holes 241. The flip-top structure 2 is provided, from its bottom, with assembly grooves 242 communicated with outer ends of the first shaft holes 241. An vertical distance between an inner end surface of each assembly groove 242 and an outer end surface of each first shaft hole 241 gradually decreases from the side away from the first shaft hole 241 to the side close to the first shaft hole 241, so that the first connecting shaft 251 can be guided into the first shaft hole 241 along the assembly groove 242, which facilitates the assembly of the sippy spout member 25. The first shaft holes 241 are arranged above the sucking channel 112, and the first limiting portion 72 is arranged at the front side of the first shaft hole 241 at an interval. When the sippy spout member 25 is in the folded state, the first positioning portion 71 is accommodated in the assembly groove 242, and the first positioning portion 71 rotates relative to the first shaft hole 241 along with the sippy spout member 25 until it extends and snaps into the first limiting portion 72, so that the sippy spout member 25 is locked in the unfolded state. As shown in FIG. 12 to FIG. 13, the sippy spout member 25 in the unfolded state is flipped by an angle of 70° to 90°, particularly 75° to 85°, relative to the sippy spout member in the folded state, so that the angle of the sippy spout member 25 in the unfolded state conforms to the human body structure and is convenient for drinking. In other examples, the first positioning portions 71 may be formed by respectively protruding from two side walls of the accommodating groove 24, and the first limiting portions 72 may be formed by respectively recessing from two sides of the rotating portion 252. In this case, the sippy spout member 25 can also be locked in the unfolded state and the folded state.

As shown in FIG. 17, in some specific examples, the sippy spout lid 26 is locked in the unfolded state and the folded state by means of third positioning structures arranged between the first lid plate 261 and the sippy spout portion 253. Each third positioning structure includes a third positioning portion 91, and a third limiting portion 92 and a fourth limiting portion 93 arranged at an interval. One of the first lid plate 261 and the sippy spout portion 253 is provided with the third positioning portions 91, and the other is provided with the third limiting portions 92 and the fourth limiting portions 93. The sippy spout lid 26 is locked in the unfolded state by making the third positioning portions 91 snap into the third limiting portions 92, and locked in the folded state by making the third positioning portions 91 snap into the fourth limiting portions 93. In this way, when the sippy spout member 26 is in the unfolded state relative to the flip-top structure 2, the first lid plate 261 can be locked in the unfolded state relative to the sippy spout portion 253 by means of the third positioning structures, which prevents the sippy spout lid 26 from rotating relative to the sippy spout portion 253, and thus prevents the sippy spout lid 26 from shaking and affecting sucking. When the sippy spout member 26 is in the folded state relative to the flip-top structure 2, the first lid plate 261 can be locked in the folded state relative to the sippy spout portion 253 by means of the third positioning structures, which prevents the sippy spout lid 26 from rotating relative to the sippy spout portion 253. A second shaft hole 2611 runs through an inner wall of each of two side connecting lugs of the first lid plate 261. Two sides of the sippy spout portion 253 are respectively recessed to form third shaft holes 2531. The sippy spout lid 26 and the sippy spout portion 253 are rotatably connected by making second connecting shafts (not shown) run through the second shaft holes 2611 and the third shaft holes 2531. In other examples, the second shaft holes 2611 or the third shaft holes 2531 may also be replaced with convex shaft structures, and the sippy spout lid and the sippy spout portion can also be rotatably connected by making the convex shaft structures sleeved in the shaft holes. In this example, the third positioning portions 91 are provided as protrusion structures convexly provided at the inner walls of the two side connecting lugs of the first lid plate 261, and the third limiting portions 92 and the fourth limiting portions 93 are provided as recess structures formed by recessing from two sides of the sippy spout portion 253. The sippy spout lid 26 in the unfolded state is locked by making the third positioning portions 91 extend and snap into the third limiting portions 92, and the sippy spout lid 26 in the closed state is locked by making the third positioning portions 91 extend and snap into the fourth limiting portions 92. In other examples, the third positioning portions 91 may also be provided as protrusion structures formed by respectively protruding from two sides of the sippy spout portion 253, and the third limiting portions 92 and the fourth limiting portions 93 are provided as recess structures formed by respectively recessing from the inner walls of the two side connecting lugs of the first lid plate 261. In this case, the sippy spout lid 26 can also be locked in the unfolded state and the closed state.

As shown in FIG. 11 to FIG. 14, in some specific examples, a pressure relief channel 113 further runs through the cup lid body 1. The pressure relief channel 113 is arranged between the direct drinking spout 14 and the sucking channel 112. When the flip-top structure 2 is in the closed state and the sippy spout member 25 is in the folded state, the sippy spout member 25 blocks the sucking channel 112 and the pressure relief channel 113. When the flip-top structure 2 is in the closed state and the sippy spout member 25 is in the unfolded state, the sippy spout member 25 opens the pressure relief channel 113 and the water passage 250 is communicated with the sucking channel 112. In this example, when the operator directly drinks and sucks water, the pressure relief channel 113 is in the open state, and the pressure relief channel 113 can circulate air inside and outside the cup so as to balance the air pressure inside and outside, so that the operator can directly drink and suck water more smoothly and easily. When the flip-top structure 2 is in the closed state and the sippy spout member 25 is in the folded state, the flip-top structure 2 covers the direct drinking channel 111, and the sippy spout member 25 blocks the sucking channel 112 and the pressure relief channel 113, which avoids water leakage and makes the dual spout cup convenient to carry about.

Figure 10:
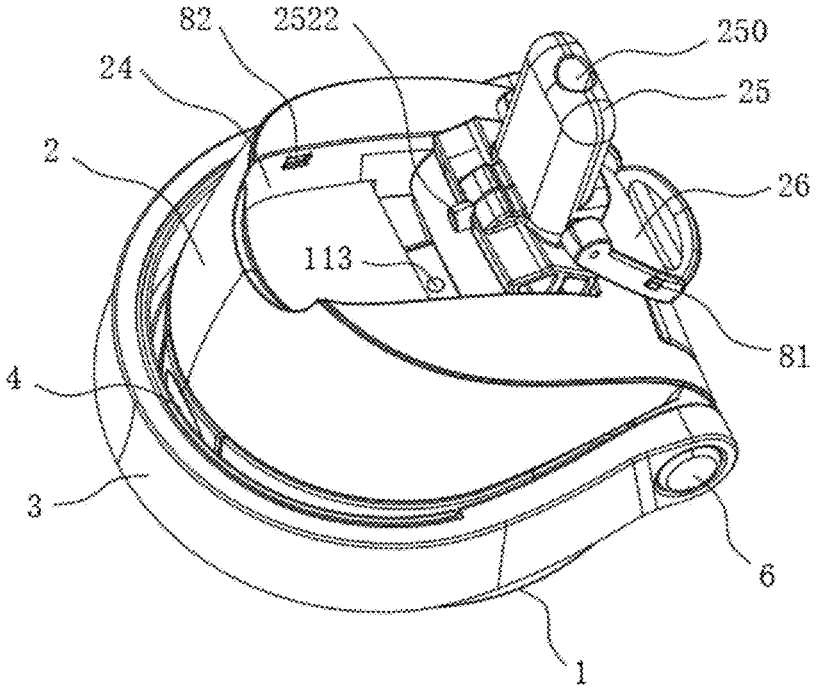
Figure 11:
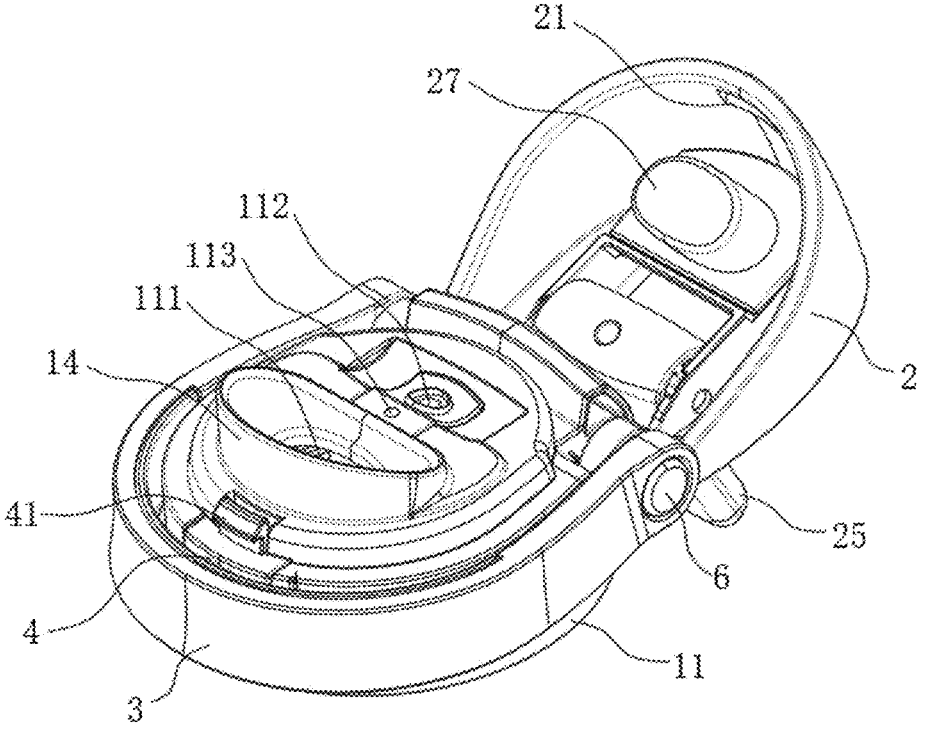

As shown in FIG. 10 and FIG. 17, in some specific examples, the rotating portion 252 includes a wheel body 2521 and a blocking body 2522 arranged at a front side of the wheel body 2521. A bottom of the flip-top structure 2 is provided with a flip-top opening 243, and the flip-top opening 243 is communicated with the accommodating groove 24. When the flip-top structure 2 is in the closed state and the sippy spout member 25 is in the folded state, the rotating portion 252 runs out of a lower side of the flip-top opening 243, such that the wheel body 2521 presses against and blocks the sucking channel 112 and the blocking body 2522 presses against and blocks the pressure relief channel 113. When the flip-top structure 2 is in the closed state and the sippy spout member 25 is in the open state, the blocking body 2522 is arranged above the flip-top opening 243 at an interval so as to form an air flow channel communicated with the outside between the flip-top opening 243 and the pressure relief channel 113, so that the air inside and outside the cup can be circulated, thereby balancing the air pressure inside and outside during sucking.

As shown in FIG. 11 to FIG. 14, in some specific examples, the bottom of the flip-top structure 2 is provided with a flexible sealing member 27 configured to block the direct drinking channel 111. When the flip-top structure 2 covers the cup lid body 1, the direct drinking channel 111 presses the flexible sealing member 27 to be deformed such that the direct drinking channel 111 is blocked, which provides good sealing performance. The cup lid body 1 includes the cup lid base 11 and a flexible connecting member 15 mounted at the upper side of the cup lid base 11. The sucking channel 112 and the pressure relief channel 113 run through the flexible connecting member 15 and the cup lid base 11. The wheel body 2521 presses the flexible connecting member 15 to be deformed such that the sucking channel 112 is blocked, and the blocking body 2522 presses the flexible connecting member 15 to be deformed such that the pressure relief channel 113 is blocked, which provides good sealing performance.

Figure 18:
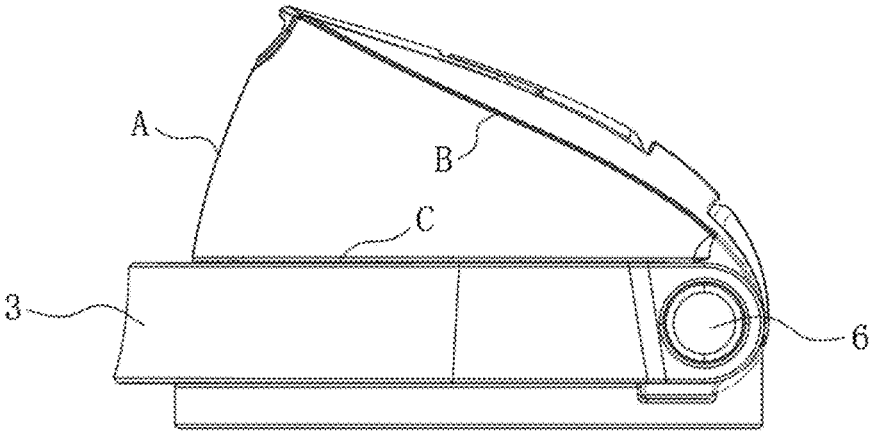
FIG. 18 is a schematic partial structural view of the dual spout cup according to an example of the disclosure.

As shown in FIG. 18, in some specific examples, the flip-top structure 2 is provided as a structure having a longitudinal section in a triangular structure. Three sides of the triangular structure are respectively a first side A, a second side B and a base C. Lengths of the first side A and the second side B are respectively less than a length of the base C, and the length of the first side A is less than the length of the second side B. The first side A is arranged at the front side of the flip-top structure 2, and the second side B is arranged at an upper side of the flip-top structure 2. The direct drinking spout 14 is arranged close to the first side A. When the flip-top structure 2 is in the closed state and the sippy spout member 25 is in the folded state, the sippy spout member 25 is arranged along a length direction of the second side B, the sippy spout portion 253 is arranged at the upper side of the direct drinking spout 14, the rotating portion 252 is arranged at the rear side of the direct drinking spout 14, the first lid plate 261 is arranged along the length direction of the second side B, and the second lid plate 262 is arranged along a length direction of the first side A. In this example, the arrangement of the sippy spout member 26 fully utilizes the remaining space beside the direct drinking spout 14, which makes the overall structure compact, further reduces the occupied space of the dual spout cup and makes the dual spout cup more convenient to package or carry. When the handle structure 3 is in the unfolded state, a lifting space for an operator to hold the handle structure 3 is formed between an inner side of the arc-shaped structure and the second side B, thereby providing a large space for holding and making the dual spout cup convenient, easy and comfortable to carry.

In some specific examples, an inner side wall of the mounting base 12 is provided with a first thread structure, and an outer side wall of an upper end opening of the cup body 200 is provided with a second thread structure. The cup lid body 1 and the cup body 200 are detachably connected by means of the threaded fit between the first thread structure and the second thread structure, which is convenient to disassemble and clean.

In summary, the above description is only a preferred embodiment of the present invention, and any equivalent changes and modifications made within the scope of the present invention patent application should be within the scope of the present invention patent.

What is claimed is:

1. A dual spout cup, comprising:

a cup body, having an accommodating cavity inside and a straw extending into the accommodating cavity;

a cup lid body, covering the cup body, a direct drinking channel and a sucking channel running through the cup lid body, a direct drinking spout being convexly provided around the direct drinking channel at an upper side of the cup lid body, the sucking channel being arranged at a rear side of the direct drinking spout, and an upper end of the straw in communication with the sucking channel;

a flip-top structure, having a rear side rotatably connected to the cup lid body and having a closed state in which the direct drinking channel is covered and an open state in which the direct drinking channel is opened, a front side of the flip-top structure and the cup lid body being locked with each other or separated from each other by means of a lid opening button, the flip-top structure being rotatably connected with a sippy spout member, a water passage being provided in the sippy spout member, the sippy spout member having a folded state of being folded relative to the flip-top structure and an unfolded state of being unfolded relative to the flip-top structure, when the flip-top structure is in the closed state and the sippy spout member is in a closed state, the sippy spout member blocking the sucking channel, and when the flip-top structure is in the closed state and the sippy spout member is in an open state, the water passage of the sippy spout member in communication with the sucking channel; and a handle structure having a rear side pivotally connected to the cup lid body and sharing a common rotating shaft with the flip-top structure, the handle structure having a folded state in which the handle structure is folded relative to the cup lid body and an unfolded state in which the handle structure is unfolded relative to the cup lid body, a front side of the handle structure shielding an outer side of the lid opening button when the handle structure is in the folded state, and the handle structure being arranged at an angle with the lid opening button and exposing the lid opening button when the handle structure is in the unfolded state;

wherein an inner diameter of the handle structure is greater than an outer diameter of the flip-top structure, the flip-top structure rotates relative to the cup lid body in a first rotating space, and the handle structure rotates relative to the cup lid body in a second rotating space, the first rotating space is arranged at an inner side of the second rotating space, and an accommodating area configured to accommodate the handle structure formed at an outer side of the cup lid body, wherein the cup lid body comprises a cup lid base and a mounting base convexly provided at an upper side of the cup lid base, and the flip-top structure covers an upper side of the mounting base; an outer diameter of the mounting base is less than an outer diameter of the cup lid base so as to form the accommodating area between an outer side surface of the mounting base and an upper side surface of the cup lid base, and when the handle structure is in the folded state, the handle structure abuts against the upper side surface of the cup lid base so as to be limited at the upper side of the cup lid base.

2. The dual spout cup according to claim 1, wherein an outer side wall of the mounting base is provided with a first fastening portion, and an inner side wall of the handle structure is provided with a second fastening portion arranged corresponding to the first fastening portion; and when the handle structure is in the folded state, the first fastening portion and the second fastening portion are fastened with each other so as to be locked.

3. The dual spout cup according to claim 2, wherein the first fastening portion is formed by protruding from the outer side surface of the mounting base, and the second fastening portion is formed by protruding from an inner side surface of the handle structure; and when the handle structure is in the folded state, the second fastening portion abuts against a lower side surface of the first fastening portion so as to be limited at a lower side of the first fastening portion.

4. The dual spout cup according to claim 1, wherein when the handle structure is in the folded state, the front side of the handle structure protrudes from an outer side of the cup lid base so as to form a pulling space between a lower side of the handle structure, an outer side of the cup lid base and an outer side of the cup body for a finger of an operator to extend into.

5. The dual spout cup according to claim 1, wherein a front side of the mounting base is concavely provided with a button slot, the lid opening button being movably connected in the button slot, and an outer side surface of the lid opening button being flush or substantially flush with the outer side surface of the mounting base; an upper side of the lid opening button is provided with a first locking portion, and the flip-top structure is provided with a second locking portion arranged corresponding to the first locking portion; and a front side of the flip-top structure and a front side of the cup lid body are locked by fastening the first locking portion with the second locking portion, and separated by separating the first locking portion from the second locking portion.

6. The dual spout cup according to claim 5, wherein a first return member is arranged between the lid opening button and the button slot, the first return member being configured to drive the lid opening button to be kept in a locked position after an operator presses the lid opening button.

7. The dual spout cup according to claim 5, wherein two sides of the lid opening button are respectively convexly provided with a guide block, and two side walls of the button slot are respectively provided with a guide groove along a pressing direction of the lid opening button; and when the lid opening button is pressed, the guide blocks extend into the correspondingly arranged guide grooves and slide along the guide grooves so as to guide the lid opening button.

8. The dual spout cup according to claim 7, wherein a bottom of the button slot is assembled with a limiting structure; the limiting structure comprises a limiting body, a second connecting block formed by protruding from an upper side of the limiting body along a vertical direction, and a limiting block formed by protruding from an outer side of the second connecting block along a horizontal direction; a bottom wall of the button slot is provided with an assembly channel for the second connecting block to pass through; the limiting structure and the button slot are assembled by fastening the bottom wall of the button slot between a lower side of the limiting block and the upper side of the limiting body; a bottom of the lid opening button is concavely provided with a limiting groove arranged along the pressing direction of the lid opening button; the limiting block is arranged in the limiting groove; and when the lid opening button slides along the pressing direction, the limiting block moves in the limiting groove.

9. The dual spout cup according to claim 3, wherein when the handle structure is in the folded state, the front side of the handle structure protrudes from an outer side of the cup lid base so as to form a pulling space between a lower side of the handle structure, an outer side of the cup lid base and an outer side of the cup body for a finger of an operator to extend into;

a front side of the mounting base is concavely provided with a button slot, the lid opening button being movably connected in the button slot, and an outer side surface of the lid opening button being flush or substantially flush with the outer side surface of the mounting base; an upper side of the lid opening button is provided with a first locking portion, and the flip-top structure is provided with a second locking portion arranged corresponding to the first locking portion; a front side of the flip-top structure and a front side of the cup lid body are locked by fastening the first locking portion with the second locking portion, and separated by separating the first locking portion from the second locking portion;

two sides of the lid opening button are respectively convexly provided with a guide block, and two side walls of the button slot are respectively provided with a guide groove along a pressing direction of the lid opening button; when the lid opening button is pressed, the guide blocks extend into the correspondingly arranged guide grooves and slide along the guide grooves so as to guide the lid opening button;

a bottom of the button slot is assembled with a limiting structure; the limiting structure comprises a limiting body, a second connecting block formed by protruding from an upper side of the limiting body along a vertical direction, and a limiting block formed by protruding from an outer side of the second connecting block along a horizontal direction; a bottom wall of the button slot is provided with an assembly channel for the second connecting block to pass through; the limiting structure and the button slot are assembled by fastening the bottom wall of the button slot between a lower side of the limiting block and the upper side of the limiting body; a bottom of the lid opening button is concavely provided with a limiting groove arranged along the pressing direction of the lid opening button; the limiting block is arranged in the limiting groove; and when the lid opening button slides along the pressing direction, the limiting block moves in the limiting groove.

10. The dual spout cup according to claim 1, wherein the cup lid body further comprises a rotating base convexly provided at an upper side of the cup lid base; the rotating base is arranged at a rear side of the mounting base; the rotating base is provided with a rotating shaft; the rotating shaft and the accommodating area are located on a same horizontal plane; the flip-top structure comprises connecting members respectively arranged at two sides of the rotating base; the handle structure is provided as an arc-shaped structure arranged around an outer side of the mounting base; the two connecting members are respectively provided with a first rotating channel arranged corresponding to the rotating shaft; two ends of the arc-shaped structure are respectively arranged at outer sides of the two connecting members and respectively provided with a second rotating channel arranged corresponding to the rotating shaft; the flip-top structure and the cup lid body are rotatably connected by means of the rotating shaft running through the first rotating channels; and the handle structure and the cup lid body are rotatably connected by means of the rotating shaft running through the second rotating channels.

11. The dual spout cup according to claim 10, wherein the mounting base is concavely provided with a sinking platform along its upper side edge; when the flip-top structure is in the closed state, a bottom of the flip-top structure is arranged in the sinking platform so as to be limited; and an outer surface of the flip-top structure is flush or substantially flush with a side surface of the mounting base.

12. The dual spout cup according to claim 10, wherein the rotating shaft is sleeved with a second return member arranged between the cup lid body and the flip-top structure, the second return member being configured to keep the flip-top structure in the open state.

13. The dual spout cup according to claim 1, wherein a top of the flip-top structure is concavely provided with an accommodating groove for accommodating the sippy spout member; the sippy spout member comprises a rotating portion and a sippy spout portion connected with the rotating portion, the rotating portion being rotatably connected in the accommodating groove; and when the sippy spout member is accommodated in the accommodating groove, an outer surface of the rotating portion is flush or substantially flush with an outer surface of the flip-top structure.

14. The dual spout cup according to claim 13, wherein an outer side of the sippy spout portion is rotatably connected with a sippy spout lid; the sippy spout lid comprises a first lid plate shielding an outer side of the sippy spout portion and a second lid plate shielding an outer side of the water passage; the sippy spout member is locked in the folded state by means of two or more second positioning structures arranged between the first lid plate and the accommodating groove; an outer side of the second lid plate is recessed to form a pulling groove for an operator to pull the sippy spout lid open; and an outer surface of the sippy spout lid is flush or substantially flush with an outer surface of the flip-top structure.

15. The dual spout cup according to claim 13, wherein each second positioning structure comprises a second positioning portion and a second limiting portion arranged corresponding to the second positioning portion; the second positioning portions are formed by respectively protruding from two sides of the first lid plate in its width direction, and the second limiting portions are formed by respectively recessing from two side walls of the accommodating groove in its width direction; and when the second positioning portions snap into the second limiting portions, the sippy spout lid is locked relative to the flip-top structure.

16. The dual spout cup according to claim 13, wherein the sippy spout member is locked in the unfolded state by means of first positioning structures arranged between the rotating portion and the accommodating groove; each first positioning structure comprises a first positioning portion and a first limiting portion arranged corresponding to the first positioning portion; one of each of the first positioning portion and each of the first limiting portion is arranged on the rotating portion, and the other is arranged on the accommodating groove; and the sippy spout member is locked in the unfolded state by making the first positioning portions snap into the first limiting portions.

17. The dual spout cup according to claim 16, wherein the sippy spout member in the unfolded state is flipped by an angle of 70° to 90° relative to the sippy spout member in the folded state.

18. The dual spout cup according to claim 13, wherein a pressure relief channel further runs through the cup lid body; the pressure relief channel is arranged between the direct drinking spout and the sucking channel; the sippy spout member comprises the rotating portion and the sippy spout portion connected with the rotating portion; the rotating portion comprises a wheel body and a blocking body arranged at a front side of the wheel body; a bottom of the flip-top structure is provided with a flip-top opening, and the flip-top opening is in communication with the accommodating groove; when the flip-top structure is in the closed state and the sippy spout member is in the folded state, the rotating portion runs out of a lower side of the flip-top opening, such that the wheel body presses against and blocks the sucking channel and the blocking body presses against and blocks the pressure relief channel; and when the flip-top structure is in the closed state and the sippy spout member is in the open state, the blocking body is arranged above the flip-top opening at an interval so as to form an air flow channel in communication with an outside between the flip-top opening and the pressure relief channel.

19. The dual spout cup according to claim 1, wherein the flip-top structure is provided as a structure having a longitudinal section in a triangular structure; three sides of the triangular structure are respectively a first side, a second side and a base; lengths of the first side and the second side are respectively less than a length of the base, and the length of the first side is less than the length of the second side; the first side is arranged at the front side of the flip-top structure, and the second side is arranged at an upper side of the flip-top structure; the direct drinking spout is arranged close to the first side; when the flip-top structure is in the closed state and the sippy spout member is in the folded state, the sippy spout member is arranged along a length direction of the second side, the first lid plate is arranged along the length direction of the second side, and the second lid plate is arranged along a length direction of the first side; and when the handle structure is in the unfolded state, a lifting space for an operator to hold the handle structure is formed between an inner side of the arc-shaped structure and the second side.

* * * * *